US006806834B2

(12) United States Patent
Yoon

(10) Patent No.: US 6,806,834 B2
(45) Date of Patent: Oct. 19, 2004

(54) MULTI BAND BUILT-IN ANTENNA

(75) Inventor: Jong Cheol Yoon, Kyungki-do (KR)

(73) Assignee: Samsung Electro-Mechanics Co., Ltd. (KR)

( * ) Notice: Subject to any disclaimer, the term of this patent is extended or adjusted under 35 U.S.C. 154(b) by 78 days.

(21) Appl. No.: 10/211,270

(22) Filed: Aug. 5, 2002

(65) Prior Publication Data

US 2003/0193438 A1 Oct. 16, 2003

(30) Foreign Application Priority Data

Apr. 11, 2002 (KR) ..... 2002-19824

(51) Int. Cl.[7] ..... H01Q 1/24; H01Q 1/38
(52) U.S. Cl. ..... 343/702; 343/700 MS
(58) Field of Search ..... 343/700 MS, 702, 343/346

(56) References Cited

U.S. PATENT DOCUMENTS 6,204,819 B1 * 3/2001 Hayes et al. ..... 343/702

* cited by examiner

*Primary Examiner*—Michael C. Wimer

(74) *Attorney, Agent, or Firm*—Lowe Hauptman Gilman & Berner, LLP

(57) ABSTRACT

A planar inverted F antenna (PIFA) includes a feed pin supplying a current, a feed line having one end electrically coupled to one end of the feed pin and having a predetermined resonance length, a coupling pin coupled to the other end of the feed line, and a radiating patch formed on a plane spaced-apart from the feed line by a predetermined distance to induce the current supplied through the other end of the coupling pin, and a slot having one end starting at a portion of an edge and the other end disposed in an inside portion of the radiating patch, and a shorting pin having one end coupled to the radiating patch and the other end coupled to a ground. The PIFA becomes smaller by using an electrical resonance length of the feed line, a shape of the feed line, and the open stub and the matching pad, improves the flexibility of the antenna design, and obtains a wider frequency band.

33 Claims, 10 Drawing Sheets

MULTI BAND BUILT-IN ANTENNA

CROSS-REFERENCE TO RELATED APPLICATION

This application claims the benefit of Korean Application No. 2002-19824, filed on Apr. 11, 2002, in the Korean Industrial Property Office, the disclosure of which is incorporated herein by reference.

BACKGROUND OF THE INVENTION

1. Filed of the Invention

The present invention relates to a multi band antenna built in a telecommunication terminal, and more particularly, to a planar inverted F antenna having a LC coupled feed line spaced-apart from a radiating patch by a predetermined distance to obtain multi frequency bands each having a wide frequency bandwidth.

2. Description of the Related Art

Recently, a mobile communication terminal is required to be compact, light, and multi-functional according to a recent demand. Electrical circuits and components built in the mobile communication terminal become smaller and multi-functional in order to satisfy the above requirement. Also, this requirement is applied to an antenna, which one of major components of the mobile communication terminal.

A conventional antenna used in the mobile communication terminal is a helical antenna and a planar inverted F antenna. The helical antenna is mounted on a top side of the mobile communication terminal together with a mono pole antenna. The helical antenna and the mono pole antenna have a quarter wavelength ($\lambda/4$) and are disposed inside the mobile communication terminal to be extended to an outside of the mobile communication terminal together with the helical antenna.

Although the helical antenna has an advantage in obtaining a high gain in a frequency band, a characteristic of synthetic aperture radars (SAR), which is an industrial standard relating to an electromagnetic wave, becomes low due to a non-directional characteristic of the helical antenna. Moreover, because the helical antenna is built on an outside of the mobile communication terminal, the helical antenna is not suitable to a portable apparatus, and an outer appearance of the mobile communication terminal will not be neat. Furthermore, it is very difficult to design the mobile communication terminal to be compact since the monopole needs a space to be built inside the mobile communication terminal.

In an effort to overcome the above problems, the planar inverted F antenna has been proposed. FIG. 1 shows a structure of a conventional planar inverted F antenna (PIFA). The PIFA includes a radiating patch 2, a shorting pin 4, a coaxial line 5, a ground plane (plate) 9. The radiating patch 2 is electrically coupled to the coaxial line 5 and has an impedance match with the ground plane 9 by forming a short circuit. A length L of the radiating patch 2 and a height H of the PIFA are designed in accordance with a first width Wp of the shorting pin 4 and a second width of the radiating patch 2.

The PIFA reduces the amount of harmful electromagnetic waves generated toward a user because the electromagnetic waves generated by current induced in the radiating patch 2 and directed toward the ground plane 9 are re-induced to the radiating patch 2. Moreover, the SAR characteristic is improved by a directional increase of the radiation waves induced (directed) in a direction toward the radiating patch 2. Furthermore, the radiating patch 2, which is used as a rectangular micro strip antenna having a predetermined length, is reduced by half in size and has a low profile structure.

The PIFA is still improved to be multi functional and developed as a dual band antenna used in two different frequency bands. FIG. 2 shows a dual band PIFA antenna 10 using the same operational principle as the PIFA of FIG. 1. The dual band antenna 10 includes a radiating patch 12 a shorting pin 14 coupling the radiating patch 12 to a ground, a coupling feed pin 15 feeding current to the radiating patch 12, a dielectric block 11 having a ground plane (plate). A slot S having a U shape is formed inside the radiating patch 12 to have the dual frequency bands and divides the radiating patch 12 into two radiating patch areas to induce (direct) the current fed through the coupling feed pin 15 along the slot S to have a resonance electric length corresponding to two different frequency bands. The dual band antenna 12 may be used in a dual frequency band, for example a GSM frequency band and a DCS frequency band.

However, recently, the frequency band is variable to a CDMA frequency band (about 824–894 MHz), a GPS frequency band (about 1570–1580 MHz), a PCS frequency band (about 1750–1870 MHz or 1850–1990 MHz), or a blue tooth frequency band (2400–2480 MHz). The PIFA antenna is required to have a multi frequency band rather than the dual frequency band because the above conventional slot of the dual band antenna is not suitable to the multi band antenna. If the dual band antenna is built in the mobile communication terminal, the profile becomes too low, and a frequency bandwidth becomes too narrow.

Since a height of the dual band antenna, which is a major factor in designing the PIFA, is limited due to a limited width of the mobile communication terminal for the portability and a neat appearance, the narrow frequency bandwidth is disadvantageous in the mobile communication terminal.

A distribution circuit, such as a chip type LC component, may be additionally attached to the dual band antenna in order to remove the above problem. Although the dual band antenna obtains a much wider frequency bandwidth by controlling the impedance matching using the distribution circuit, unexpected problems, such as an efficiency of the dual band antenna, occur because the dual band antenna is interfered with the distribution circuit, which is an outside circuit coupled to the dual band antenna.

Therefore, we contemplate a PIFA to have a low profile structure, to be able to be used in a variety of frequency bands, and to improve characteristics of the narrowed frequency bands.

SUMMARY OF THE INVENTION

In order to overcome these and other problems, it is an object according to the present invention to provide a planar inverted F antenna having a LC coupled feed line spaced-apart from a radiation patch having a conductive pattern to obtain multi frequency bands each having a much wider frequency band width.

Additional objects and advantages of the present invention will be set forth in part in the description which follows and, in part, will be obvious from the description, or may be learned by practice.

These and other objects may be achieved by providing a planar inverted F antenna (PIFA) having predetermined structure, function, and shape of a feed line according to embodiments of the present invention.

According to an aspect of the present invention, the PIFA includes a feed pin directing a current, a feed line having one end electrically coupled to one end of the feed pin and having a predetermined resonance length, a coupling pin coupled to the other end of the feed line, and a radiating patch formed on a plane spaced-apart from the feed line by a predetermined distance to induce (feed) the current directed (fed) through the other end of the coupling pin, and a slot having one end starting at a portion of an edge and the other end disposed in an inside portion of the radiating patch, and a shorting pin having one end coupled to the radiating patch and the other end coupled to a ground.

According to another aspect of the present invention, the PIFA may include a feed pin directing a current, a feed line having one end electrically coupled to one end of the feed pin and having a predetermined resonance length, a radiating patch being spaced-apart from the feed line and being supplied through the feed pin, a shorting member having one end coupled to the radiating patch and the other end formed with a coupling pad to be coupled to a ground plate of a housing of a telecommunication terminal and to the other end of the feed line.

The PIFA may include a feed pin supplying a current, a first feed line having one end electrically coupled to one end of the feed pin and having a first resonance length, a second feed line having one end coupled to one end of the feed pin to be parallel to the first feed line and having a second resonance length, a radiating patch having a slot starting at an edge of the radiating patch and extended to an inside portion of the radiating patch, the radiating patch divided by the slot into a first patch area supplied with the current through the other end of the feed pin and a second patch area supplied with the current through the other end of the second feed line, a coupling pad formed to couple the radiating patch to a ground of a housing of a telecommunication terminal, and a shorting member having one end coupled to the coupling pad coupled to the other end of the first feed line and the other end coupled to the other end of the first patch area.

The PIFA may be formed with an LC coupling unit capable of adjusting a capacitance of an antenna by an area of the feed line and a distance with the radiating patch and controlling an inductance of the antenna by using a length of the feed line when the feed line having a predetermined resonance length is disposed to be spaced-apart from the radiating patch. The PIFA allow the frequency band to be expanded. A multi band antenna can be easily designed with various structures of the feed lines.

The feed line is coupled to the feed pin at one end thereof. There exist two different types of the feed lines in accordance with a coupling structure of the other end of the feed lines.

A first type feed line has the other end coupled to the radiating patch to be supplied with the current and combined with the radiating patch to have an electrical resonance length. A second type feed line has one end and the other end coupled to a feed pin and the shorting pin (or the coupling pad disposed below the shorting pin) to form the electrical resonance length. The above first type feed line and the second type feed line may be combined to form a third type feed line.

The LC coupled feed line has a predetermined electrical resonance length and one of various types of conductive patterns each disposed on a plane spaced-apart by a distance from another plane on which another conductive pattern (e.g. radiating patch) is formed to obtain different resonance length(s). The feed line may have a simple loop shape, a meander shape, and a combination of the simple loop shape and the meander shape.

A portion of the feed line disposed on a first plane is extended to a second plane different from and spaced-apart from the first plane. When the antenna is formed with at least two dielectric layers, and when the feed line has a first portion having a first conductive pattern and a second portion having a second pattern, the first portion and the second portion of the feed line are formed on the same plane or respective different planes. This antenna has the different electrical resonance lengths as well as the low profile.

BRIEF DESCRIPTION OF THE DRAWINGS

These and other objects and advantages of the present invention will become apparent and more readily appreciated from the following description of the preferred embodiments, taken in conjunction with the accompanying drawings of which.

DETAILED DESCRIPTION OF THE PREFERRED EMBODIMENTS

Figure 1:
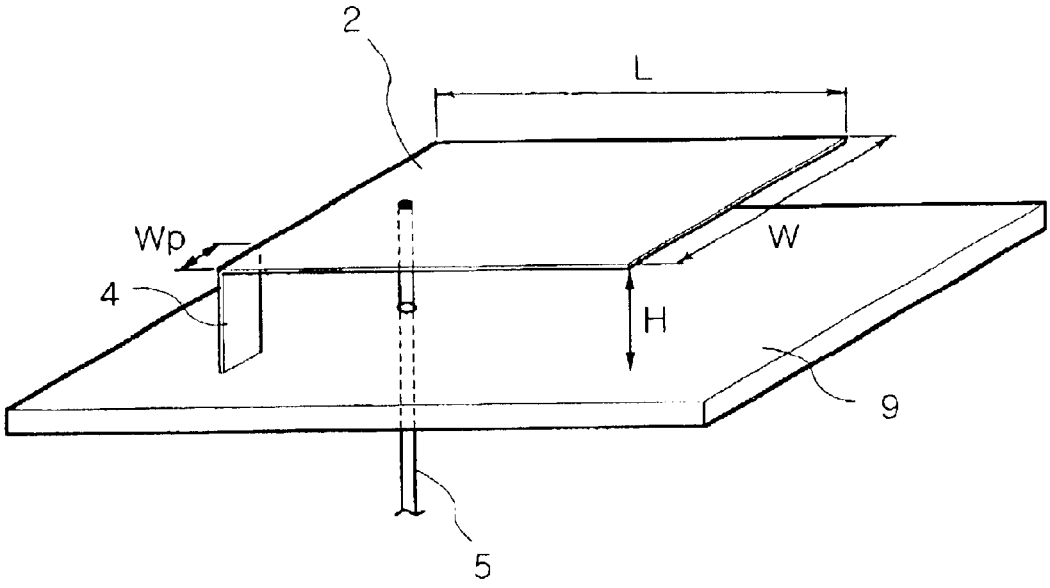
PRIOR ART FIG. 1
FIG. 1 is a perspective view showing a principle of a conventional planar inverted F antenna.

Reference will now be made in detail to the present preferred embodiments of the present invention, examples of which are illustrated in the accompanying drawings, wherein like reference numerals refer to the like elements throughout. The embodiments are described below in order to explain the present invention by referring to the figures.

Figure 2:
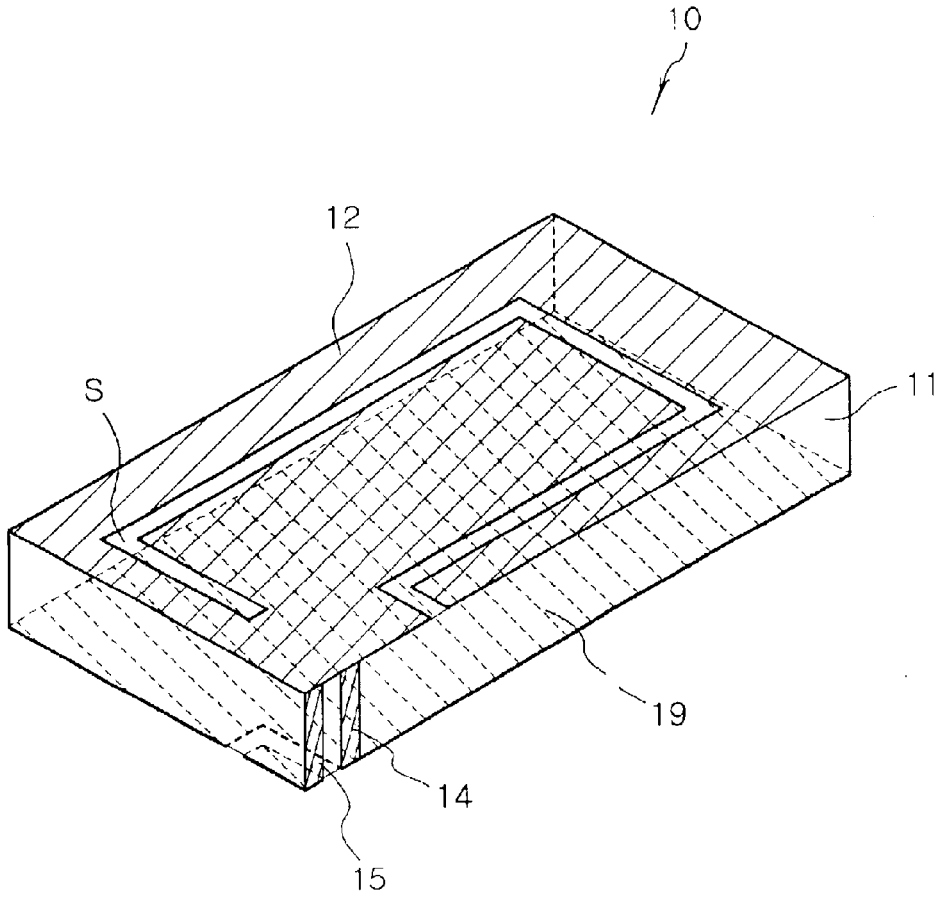
PRIOR ART FIG. 2
FIG. 2 is a perspective view of a conventional dual band PIFA.
Figure 3A:
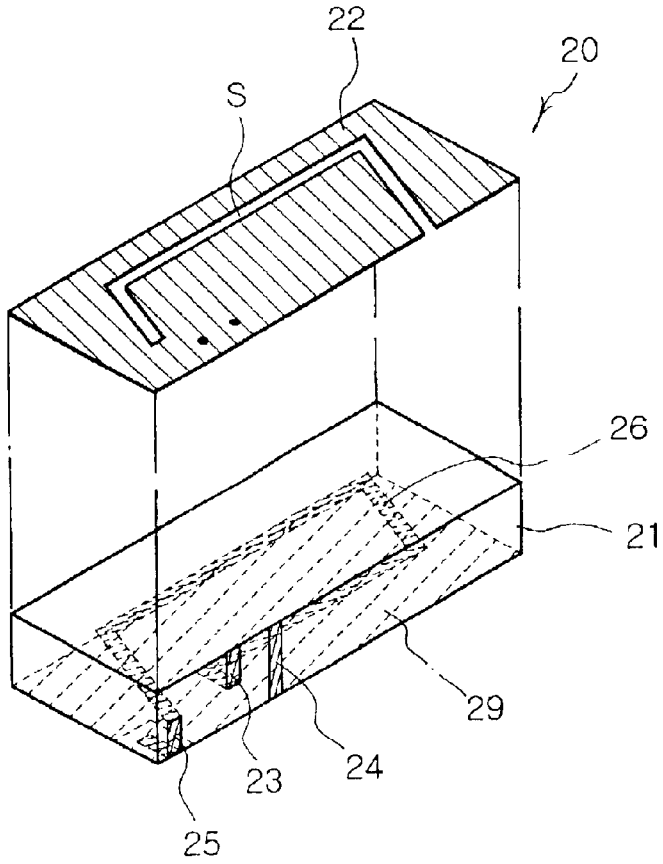
FIGS. 3A and 3B are perspective views of a planar inverted F antenna (PIFA) and a coupling deed line according to an embodiment of the present invention.

FIG. 3A shows a perspective view of a planar inverted F antenna (PIFA) 20 according to an embodiment of the present invention. The PIFA 20 includes a radiating patch 22 and a ground plane (plate) 29 formed on a top and a bottom of a dielectric block 21, respectively, and having a rectangular shape, a shorting pin 24, a feed pin 25, a feed line 26, and a coupling pin 23. The radiating patch 22 is formed with a slot S to obtain an electrical resonance length of a quarter wavelength ($\lambda/4$) corresponding to at least two frequency bands. It is possible that the slot S is formed to have at least the resonance length. It is possible that the slot S starts at one edge of the radiating plane 22, makes a bend, and extends close to the feed pin 25 to form a U shape disposed inside a patch area of the radiating patch 22 as shown in FIG. 2.

Figure 3B:
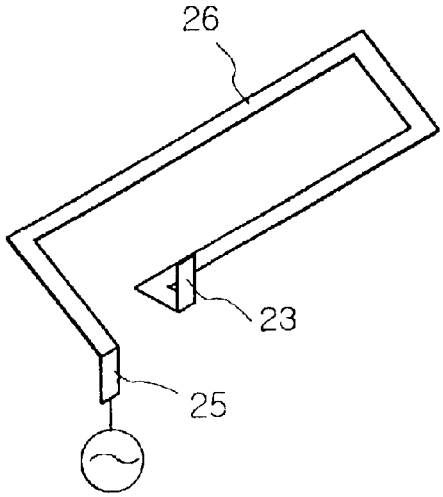

The feed line 26 includes a predetermined length to form a loop structure disposed between the radiating patch 22 and the ground plane 29. FIG. 3B is a perspective view of the feed line 26 of the PIFA 20 of FIG. 3A. The feed line having a loop type structure includes a first end coupled to the feed pin 25, a second end being opposite to the first end to be coupled to the radiating patch 22 through the coupling pin 23, and a loop shaped line formed between the first and second ends to be spaced-apart from the radiating patch 22.

The feed line 26 has an inductance value L determined by a length of the feed line 26 and a capacitance value determined by an area and a distance from the radiating patch 22. These values of the feed line are dependent from a material forming the dielectric block disposed between the radiating patch 22 and the ground plane 29. Accordingly, when the feed line 26 is implemented in the PIFA 20, the feed line 26 functions as an LC coupling circuit for impedance matching without any additional external matching circuit and obtains much wider frequency bands without sacrificing a decrease of an efficiency of the PIFA 20.

The feed line 26 has an electrical resonance length thereof since a current is supplied to the second end of the loop type feed line 26 through the radiating patch 22 and forms additional electrical resonance lengths due to a combination of the feed line 22 and the slot S of the radiating patch 22. As a result, the PIFA 20 having the feed line 26 has a triple antenna structure being resonated in various different frequency bands. Respective frequency bands are explained in reference with shape of the slot S of the radiating patch 22 and the feed line 26.

The loop type feed line 26 is capable of adjusting the impedance matching and the frequency tuning in accordance with the electrical resonance lengths and the shape of the feed line. In order to enable the loop type feed line 26 to easily adjust the impedance matching and the frequency tuning, another additional component may be added to the PIFA 20 of FIG. 3A as shown in FIGS. 4A, 4B, and 4C.

Figure 4A:
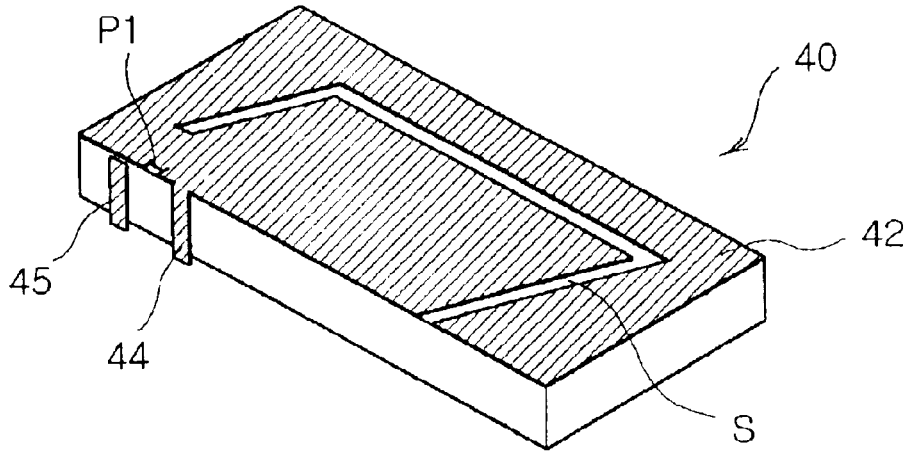
FIGS. 4A, 4B, and 4C are perspective views of the PIFA and a plan view of a coupling feed line according to another embodiment of the present invention.
Figure 4B:
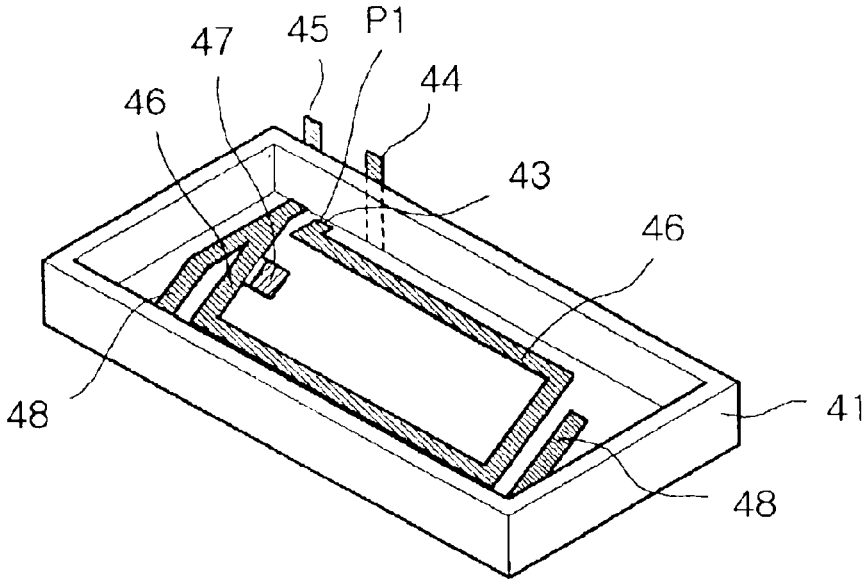
Figure 4C:
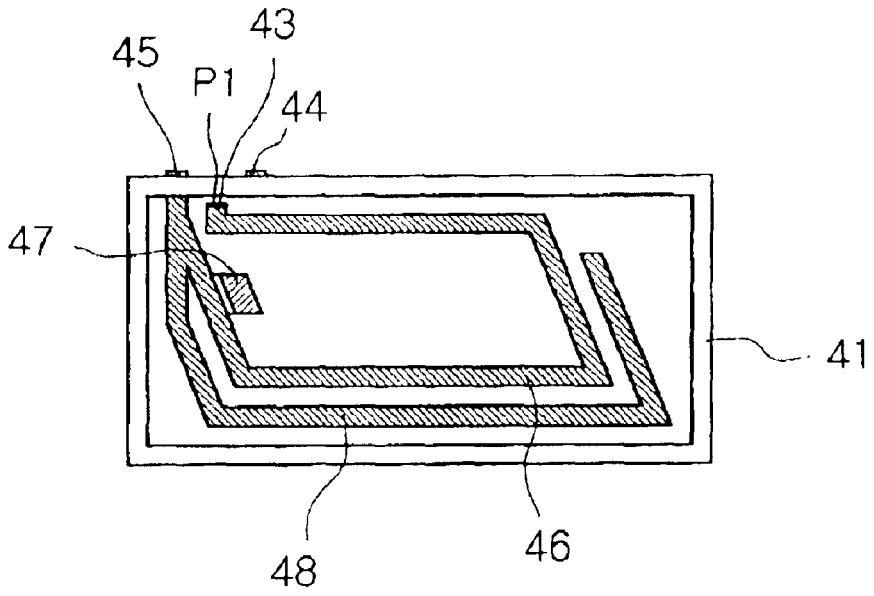

FIGS. 4A, 4B, and 4C show another improved PIFA 40 having the same impedance matching and the frequency tuning as well as the same structure as the PIFA 20 as shown in FIG. 3A. FIGS. 4A through 4C show a perspective view, a partial perspective view, and a plan view of the PIFA 40, respectively.

The PIFA 40 shown in FIG. 4A does not include a dielectric block of FIGS. 2 and 3A and is mounted on and coupled to a ground plate (not shown) provided in a housing of a communication terminal not having the ground plane 29 of the PIFA 20 of FIG. 3A. Although a case 41 of the PIFA 40 is made of an insulation material, the case 41, however, is not limited to the insulation material. The case of the PIFA 40 is made of a plastic material according to this embodiment of the present invention.

The PIFA 40 of FIG. 4A includes a radiating patch 42 at a top surface thereof. the radiating patch 42 is formed with the slot S to form the electrical resonance length of a quarter wavelength ($\lambda/4$) corresponding to desired frequency bands as shown in the PIFA 20 of FIG. 3A. A position P1 marked on the radiating patch 42 as a dot indicates a point electrically coupled to a third end of a feed line 46 as shown in FIGS. 4B and 4C. This coupling between the feed line 46 and the radiating patch 42 is provided by perforating the case 41 made of the insulation material. A shorting pin 44 extended from and coupled to the radiating patch 42 is formed along a side wall of the case 41.

In FIG. 4B, the case 41 of the PIFA 40 has a structure having a box shape, an inside surrounded by the side wall, and an outside corresponding to the inside. The shorting pin 44 formed along the side wall of the case 41 forms a short circuit between the radiating patch 42 and the ground plate of a housing of a communication terminal. An additional ground coupling pad having a predetermined area may be provided between the shorting pin 44 and the ground plate of the housing of the communication terminal to form the short circuit.

The feed line 46 is formed and disposed in an inside of the case 41 and has a third end coupled to a feed pin 45 and a fourth end coupled to the radiating patch 46 through the coupling pin 43. Although the feed line 46 has a predetermined length surrounding the inside of the case 41, the length and shape of the feed line 46 vary in response to a desired LC coupling structure, such as a meander shape and a three dimensional shape having a first portion formed on a first plane and a second portion coupled to the first portion and formed on a second plane different from the first plane. According to the embodiment of the present invention, the PIFA 40 may include a matching pad 47 and an open stub 48 to easily adjust the impedance matching and the frequency tuning. The feed pin 45 is formed along the side wall of the case 41 through a perforation formed on the side wall of the case 41. The feed pin 45 and the shorting pin 44 have a longer height than that of the side wall of the case 41 to be bent along the side wall of the case 41 and to be coupled to an external feed circuit and the ground plate of the telecommunication terminal, respectively.

FIG. 4C shows the matching pad 47 and the open stub 48 in detail. The matching pad 47 is formed on the feed line 46 disposed adjacent to the feed pin 45, and the open stub 48 is disposed to be parallel to the feed line 46 and has one end coupled to the feed line 46.

The PIFA 40 may have various shapes and types of the feed line 46 reducing entire profile of the PIFA 40 and perform the impedance matching and the frequency tuning in wide frequency bands. Any type of the matching pad 47 and the open stub 48 may be selectively combined with any type of a PIFA according to the embodiment of the present invention.

Figure 5:
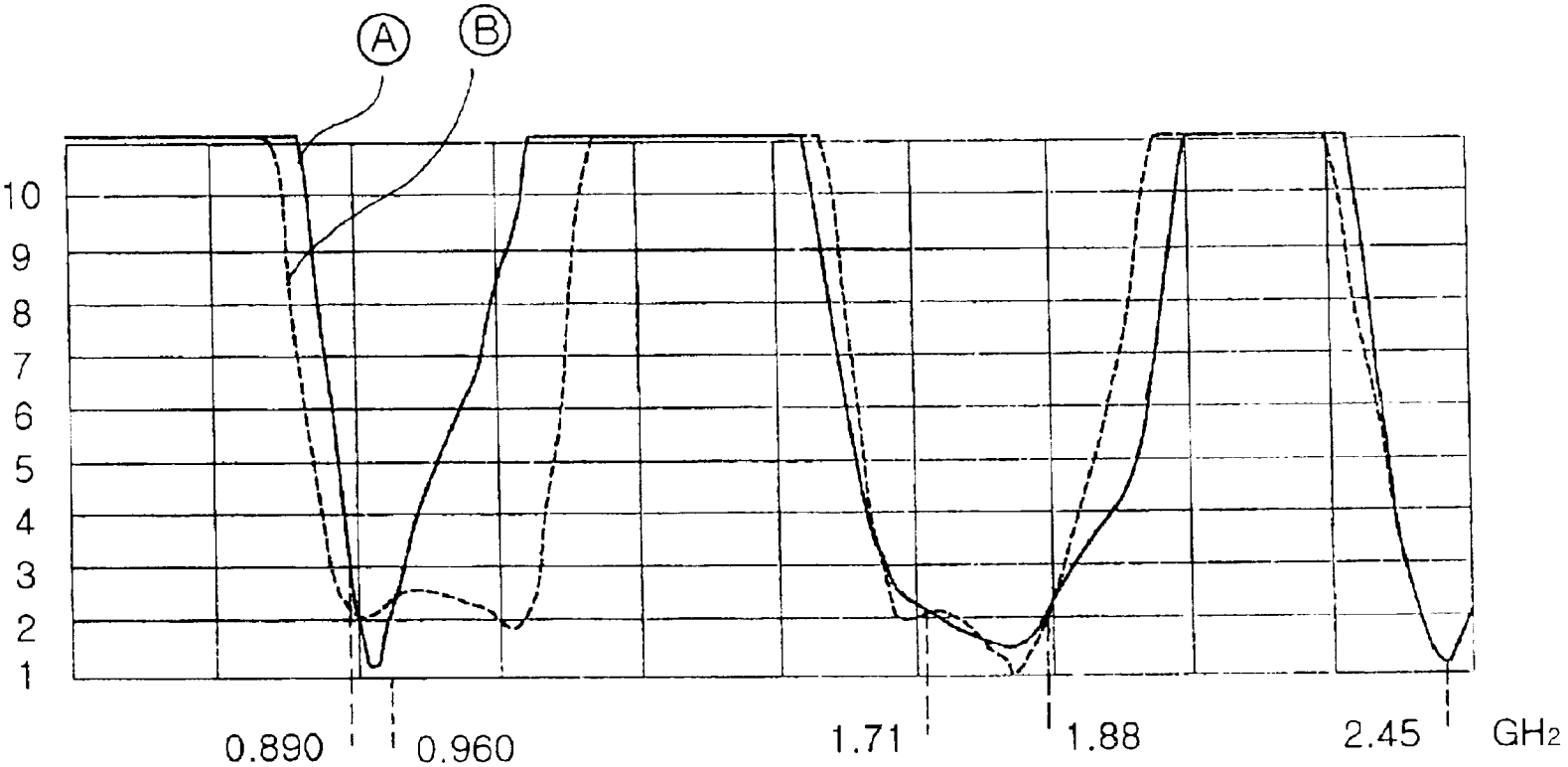
FIG. 5 is a graph showing a voltage standing wave ratio (VSWR) of the PIFA of FIG. 3A.

As described above, the PIFA 40 becomes smaller than a conventional PIFA in size and obtains the wider frequency bandwidth than the conventional PIFA. FIG. 5 is a voltage standing wave ratio (VSWR) graph showing a triple band antenna used in the GSM frequency band (890–960 MHz), the DSC frequency band (1.71–1.88 GHz), the blue tooth frequency band (2.4–2.45 GHz).

As shown in FIG. 5, VSWR values in three frequency bands are lower than 2.5. This means that the PIFA 40 is more efficient than a conventional PIFA. If the PIFA 40 is implemented in the triple band antenna, sufficiently broad frequency bandwidths are obtained corresponding to respective desired frequency band. Although the VSWR value of the PIFA 20 of FIG. 3A is higher in the GSM frequency band (about 890 MHz) than the VSWR value of the PIFA 40 of FIG. 4A, the VSWR value of the PIFA 20 can be improved and lowered by adding the matching pad 47 and the open stub 48 to the PIFA 20 of FIG. 3A.

A second type of the PIFA is provided according to another embodiment of the present invention and is different from the loop type feed line of FIG. 4A. The feed line may have one end coupled to a shorting pin or a ground coupling pad directing the current to a radiating patch and may have a predetermined length and another end disposed to be spaced-apart from the radiating patch to form a LC coupling with the radiating patch.

Figure 6A:
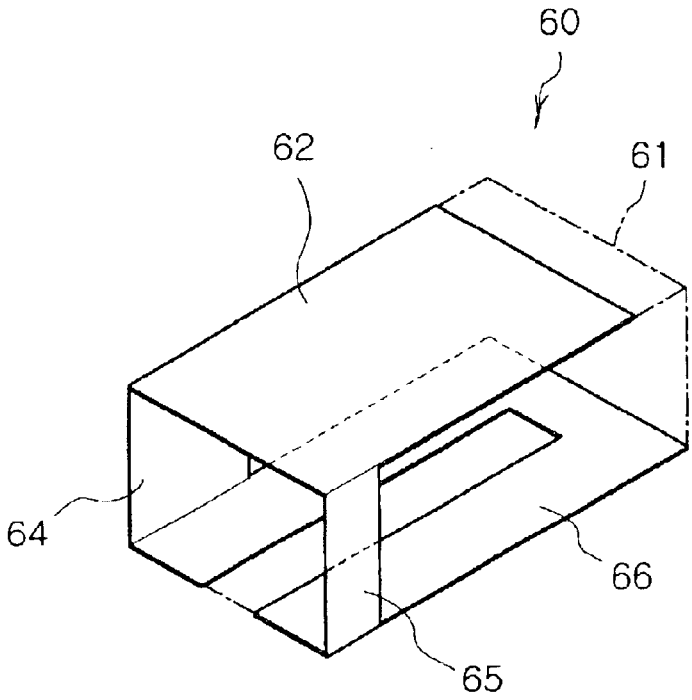
FIGS. 6A and 6B are perspective views of the PIFA and the coupling feed line according to another embodiment of the present invention.
Figure 6B:
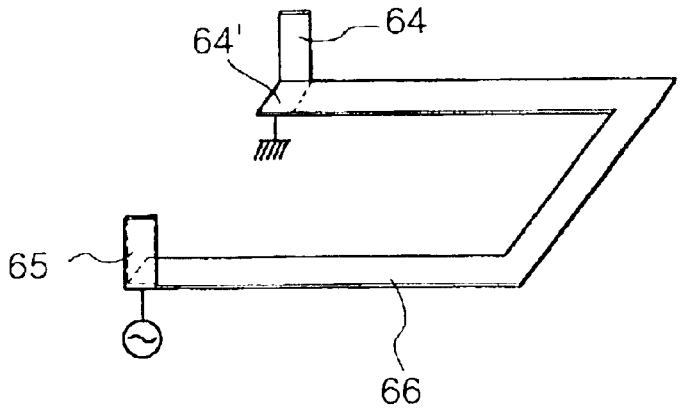

FIGS. 6A and 6B are perspective views of a PIFA 60 and a loop type feed line 66, respectively. In FIG. 6A, the PIFA 60 includes a ceramic body 61 of a hexahedron but excludes the ground plate to be coupled to a ground of a printed circuit board of the communication terminal in which the PIFA 60 is mounted. The PIFA includes a radiating patch 62, a shorting pin 64, and the ceramic body 61 formed with a loop type feed line 66 on each surface thereof.

A feed pin 65 may be spaced-apart from the radiating patch 62 to be electrically coupled to the radiating patch 62 or may be directly coupled to the radiating patch 62. The shorting pin 64 includes one end coupled to the radiating patch 62 to form the short circuit, and the loop type feed line 66 includes one end coupled to the feed pin 65 and another end coupled to the shorting pin 64. As shown in FIG. 6B, if a coupling pad 64' is provided to be disposed adjacent to another end of the shorting pin 64 to be coupled to the ground of the housing of the communication terminal, it is possible that the loop type feed line 66 is coupled to the coupling pad 64.

The loop type feed line 66 according to this embodiment of the present invention is illustrated in FIG. 6B. The loop type feed line 66 is coupled to the grounded shorting pin 64 or the coupling pad 64' and to the feed pin 65 to have the electrical resonance length corresponding to the desired frequency bands. Also, the feed line 66 can be used in different frequency bands by directing the current to the radiating patch 62 through the feed pin 65. The PIFA 60 having the feed line 66 as shown in FIGS. 6A and 6B can be implemented in the dual band antenna. If the radiating patch 62 of the PIFA 60 is formed with the slot S, the PIFA 60 can be used as the triple frequency band antenna.

Figure 7:
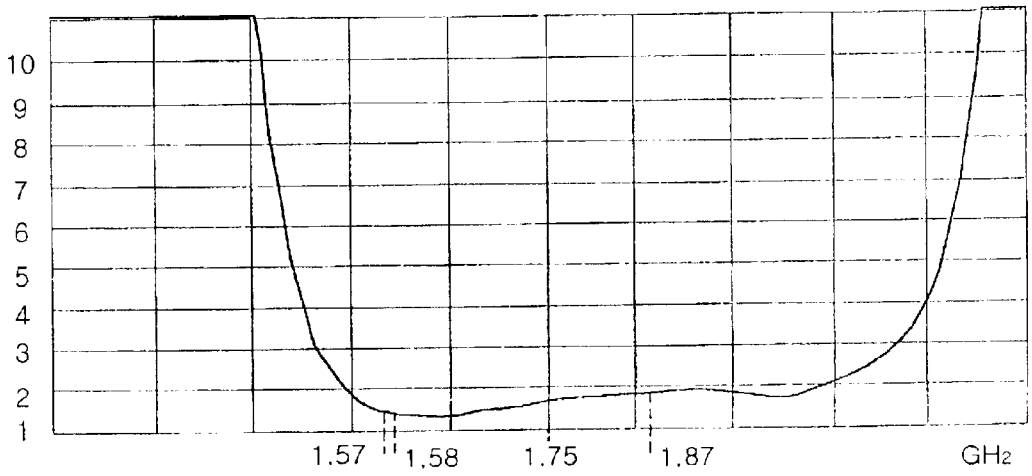
FIG. 7 is a graph showing the VSWR of the PIFA of FIG. 6A.

FIG. 7 shows the VSWR value of the PIFA 60 of FIGS. 6A and 6B. The VSWR value is indicated in the GPS frequency band (1.57–1.58 GHz) and the PCS frequency band (1.75–1.87 GHz). Where the VSWR value of the PIFA is below 2.5, a frequency bandwidth is in the range of about 600 MHz. The GPS frequency band and the PCS frequency band are included in the frequency bandwidth of about 600 MHz. If the PIFA is minimized in size, the PIFA 60 may be designed to be used in WCDMA (IMT-2000) frequency band. Various types of multi band antennas can be designed by using the loop type feed line constructed according to embodiments of the present invention, and the wider frequency band can be obtained.

Figure 8:
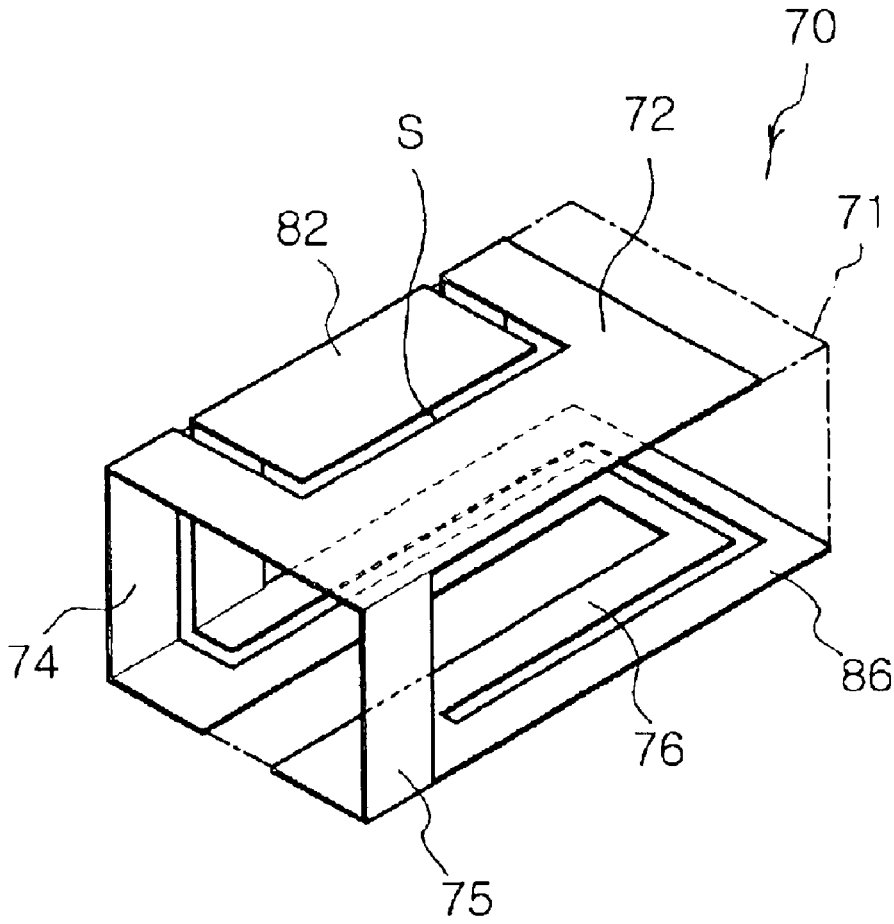
FIG. 8 is a perspective view of the PIFA according to another embodiment of the present invention.

A third type of a feed line of the PIFA may be made by any combination of the PIFA 20 of FIG. 3A, the PIFA 40 of FIG. 4A, and the PIFA of FIG. 6A. FIG. 8 shows the third type of the PIFA having two types of the feed lines.

In FIG. 8, the PIFA 70 includes a shorting pin 74 and a feed pin 75 both formed on a ceramic body 71, a radiating patch 72, 82, a first loop type feed line 76, and a second loop type feed line 86. The first feed line 76 has a first length corresponding to that of the loop type feed line 66 of FIG. 6A, and the second feed line 86 has a second length other than the first length. The second feed line 86 is coupled to one end of the feed pin 75 and formed to be parallel to the first feed line 76.

The radiating patch 72, 82 is divided by the slot S starting at a portion of one edge and extended to another portion of the one edge of the radiating patch into a first patch area 72 coupled to another end of the feed pin 75 and a second patch area 82 coupled to another end of the second feed line 86. The PIFA 70 may have a combination of the feed line 20 or 40 of FIGS. 3A and 4A and the feed line 60 of FIG. 6A. The PIFA 70 has first electrical resonance lengths corresponding to two loop type feed lines 76, 86 and second electrical resonance lengths corresponding to the first and second radiating patch areas and being different from the first electrical resonance lengths to perform in four frequency bands.

Figure 9:
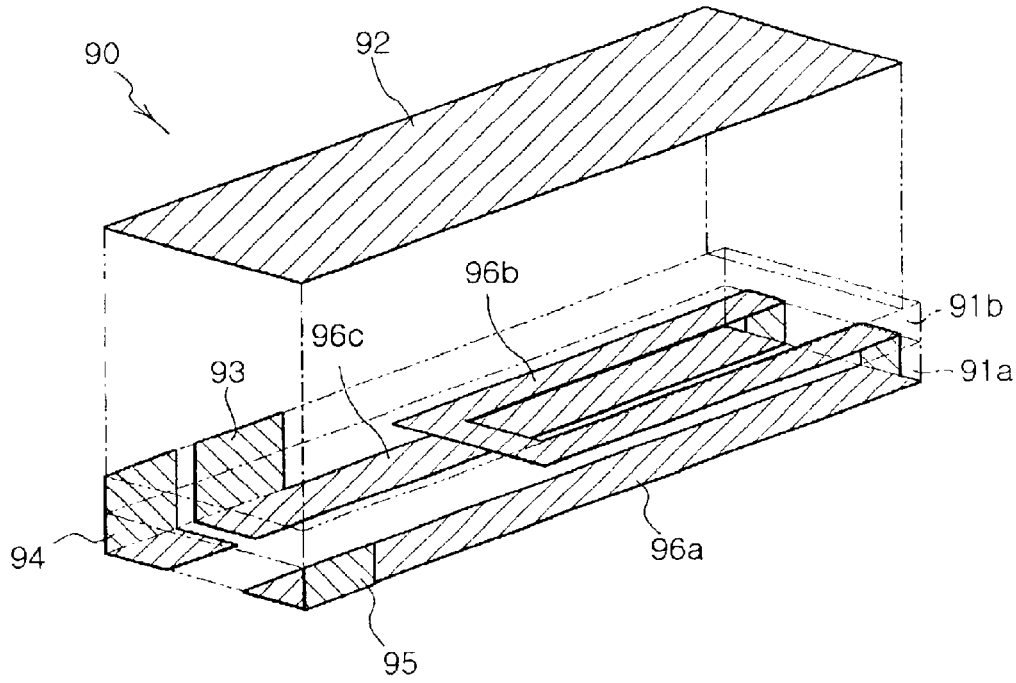
FIG. 9 is a perspective view of the PIFA according to another embodiment of the present invention.

Although the loop type feed line is used in the PIFA, various types of the feed lines may be implemented in a PIFA 90 as shown in FIG. 9. The PIFA 90 includes third, fourth, and fifth feed lines 96*a*, 96*b*, 96*c* disposed in respective different planes. Two dielectric layers 91*a*, 91*b* are disposed between the third and fifth feed lines 96*a*, 96*c*, and between the fifth and fourth feed lines 96*c*, 96*b* in order to easily mount the feed lines in the PIFA 90.

The PIFA 90 of FIG. 9 includes a radiating patch 92, a feed pin 95, the third, fourth, and fifth feed lines 96*a*, 96*b*, 96*c* extended from the feed pin 95, and a shorting pin 95 grounding the radiating patch 92. Since one of the third, fourth, and fifth feed line 96*a*, 96*b*, 96*c* may have the same structure as the PIFA 20 of FIG. 3A, and since two of the third, fourth, and fifth feed lines 96*a*, 96*b*, 96*c* are disposed on respective different planes, the PIFA 90 forms a three dimensional structure using two dielectric layers 91*a*, 91*b*.

The third feed line 96*a* is disposed below the first dielectric layer 91*a* to be coupled to the feed pin 95, the fourth feed line 96*c* is disposed between the first dielectric layer 91*a* and the second dielectric layer 91*b* (below the second dielectric layer 91*b* or on the first dielectric layer 91*a*) to be coupled to the third feed line 96*a*, and the fifth feed line 96*c* is disposed below the first dielectric layer 91*a* to be coupled to the radiating patch 92 through the coupling pin 93.

Since at least two or three feed lines are disposed on respective different planes, various types of the three dimensional feed line structures can be implemented in the PIFA. The electrical resonance length, a distance between the different feed lines, and a pattern of each feed line may vary and increase a design flexibility of the PIFA. In addition to the three dimensional structure having feed lines disposed on respective different layers, a meander line structure may be partially or entirely used or combined with the above three dimensional structure of the PIFA.

Although two dielectric layers are used in the PIFA in the embodiment of the present invention, the number of the dielectric layers may vary, and a dielectric case having two layer structure may be used. The feed lines may be connected to each other through a conductive pin or a conductive through hole.

As described above, the PIFA according to the present invention enables an antenna structure to become smaller by using an electrical resonance length of a feed line, a shape of the feed line, and the open stub and the matching pad, to improve the flexibility of the antenna design, and to obtain a wider frequency band.

Although a few preferred embodiments of the present invention have been shown and described, it would be appreciated by those skilled in the art that changes may be made in third embodiment without departing from the principles and sprit of the invention, the scope of which is defined in the claims and their equivalents.

What is claimed is:

1. A planar inverted F antenna, comprising:

a feed pin through which a current is directed;

a feed line having a first end coupled to the feed pin and a second end extended from the first end by a predetermined length;

a coupling pin having one end coupled to said second end of said feed line;

a radiating patch formed on a surface spaced-apart from said feed line to induce the current directed through the other end of said coupling pin, said radiating patch having a slot having one portion starting from one edge of said radiating patch and another portion extended from the one portion to be disposed in an inside of said radiating patch; and a shorting member having one end coupled to one end of said radiating patch and the other end coupled to a ground unit.

2. The antenna of claim 1, wherein said antenna comprises a conductive body and a non-conductive body having an inside and an outside surrounded by said conductive body, said radiating patch formed on a portion of said conductive body disposed on said outside of said non-conductive body, and said feed line is disposed in said inside of said non-conductive body.

3. The antenna of claim 2, wherein said coupling pin is a perforation of said non-conductive body to couple the radiating patch and the feed line.

4. The antenna of claim 2, wherein said feed pin is made of a conductive material extended from said feed line to have a height greater than that of a side wall of said non-conductive body.

5. The antenna of claim 2, wherein said shorting member is made of a conductive material extended from said radiating patch to have a height greater than that a side wall of said non-conductive body.

6. The antenna of claim 1, wherein said feed line has a loop shape.

7. The antenna of claim 1, wherein said feed line has a meander shape.

8. The antenna of claim 1, further comprising:

a plurality of stacked dielectric layers and a conductive pattern forming said feed line, wherein said feed line formed on a surface of one of said dielectric layers comprises at least a portion formed on another surface of the one of said dielectric layers or on a surface of another one of said dielectric layers.

9. The antenna of claim 1, wherein another portion of said slot is disposed adjacent to a portion of said radiating patch supplied with the current.

10. The antenna of claim 1, wherein the one end of said shorting member coupled to a radiating patch area is disposed on the same edge as another radiating patch area coupled to said feed line.

11. The antenna of claim 1, wherein said antenna comprises an external communication terminal having a housing and a ground formed on the housing to be coupled to said shorting pin, and said antenna comprises a coupling pad coupling said shorting pin to said ground of said hosing of said communication terminal.

12. The antenna of claim 1, wherein said antenna comprises a ground unit formed on a surface facing said radiating patch and coupled to another end of said shorting member.

13. The antenna of claim 1, wherein said feed line comprises a matching pad disposed adjacent to said feed pin to adjust a resonance impedance of the feed line.

14. The antenna of claim 1, wherein said antenna comprises an open stub coupled to said feed pin and having a predetermined length in a lengthwise parallel to said feed line.

15. A planar inverted F antenna in a communication terminal having a ground, said antenna comprising:

a feed pin having a feed pad formed on one end thereof to direct a current;

a feed line having a first end coupled to said feed pin and having a second end extended from said first end by a predetermined length;

a radiating patch formed on a surface spaced-apart from said feed line to induce the current transmitted through the feed pin; and a shorting member having one end coupled to said radiating patch, the other end coupled to the feed line, and a coupling pad disposed adjacent to the other end of the shorting member to be coupled to the ground;

wherein said radiating patch comprises:

a slot having one end starting from one edge of said radiating patch and the other end disposed in an inside area of the radiating patch, said slot dividing said radiating patch into two patch areas each having an electric resonance length corresponding to a frequency band.

16. The antenna of claim 15, wherein said feed line has a shape of a loop.

17. The antenna of claim 15, wherein said feed line has a shape of a meander.

18. The antenna of claim 15, further comprising at least two dielectric layers, wherein said feed pin, said radiating patch, and said coupling pad are formed on corresponding surfaces of said dielectric layers, and said feed line comprises a first portion formed on one of the dielectric layers and a second portion formed on the other one of said dielectric layers.

19. The antenna of claim 15, wherein the other end of said slot is disposed adjacent to a portion of said radiating patch supplied with the current.

20. The antenna of claim 15, wherein the other end of said feed pin is spaced-apart from the radiating patch and electrically coupled with said radiating patch.

21. The antenna of claim 15, wherein the other end of said feed pin is coupled to said radiating patch.

22. The antenna of claim 15, further comprising:

a matching pad formed on said feed line and disposed adjacent said feed pin to control impedance of the feed line.

23. The antenna of claim 15, further comprising:

an open stub coupled to the other end of said feed pin, disposed to be parallel to said feed line, and having a predetermined length.

24. A planar inverted F antenna in a telecommunication terminal having a ground, said antenna comprising:

a feed pin directing a current;

a first feed line having one end coupled to said feed pin and having a first predetermined length;

a second feed line having one end coupled to said feed pin, disposed to be parallel to said first feed line;

a radiating patch formed on a surface spaced-apart from said first and second feed lines by a predetermined distance, said radiating patch having a slot starting from one edge end and extending to another edge of the radiating patch to divide said radiating patch into a first patch area coupled to said feed pin and a second patch area coupled to the other end of said second feed line; and a shorting member having a coupling pad formed on one end of said shorting member to be coupled to said ground, said shorting member having the other end coupled to said first patch area of said radiating patch, said coupling pad coupled to the other end of said first feed line.

25. The antenna of claim 24, wherein one of said first and second feed lines is a loop shape.

26. The antenna of claim 24, wherein one of said first and second feed lines is a meander shape.

27. The antenna of claim 24, further comprising at least two dielectric layers, wherein one of said first and second feed line comprises a first portion formed on one of the dielectric layers and a second portion formed on the other one of said dielectric layers.

28. The antenna of claim 24, wherein one of said first and second feed lines comprises:

a coupling pin coupling the other end of said one of said first and second feed lines to said radiating patch.

29. The antenna of claim 24, wherein said one edge and the other edge of said slot of said radiating patch are formed on the same edge of said radiating patch.

30. The antenna of claim 24, wherein the other end of said feed pin is spaced-apart from the radiating patch and electrically coupled with said radiating patch.

31. The antenna of claim 24, wherein the other end of said feed pin is coupled to said radiating patch.

32. The antenna of claim 24, further comprising:

a matching pad formed on said feed line and disposed adjacent said feed pin to control impedance of the feed line.

33. The antenna of claim 24, further comprising:

an open stub coupled to the other end of said feed pin, disposed to be parallel to said feed line, and having a predetermined length.

* * * * *